US006016974A

United States Patent [19]

Mascitelli

[11] Patent Number: 6,016,974

[45] Date of Patent: Jan. 25, 2000

[54] MICROPUMP FOR THE NEBULIZATION OF FLUIDS WITH ENHANCED METERING VALVE

[75] Inventor: Francesco Mascitelli, Pescara, Italy

[73] Assignee: SAR S.p.A., San Giovanni Teatino, Italy

[21] Appl. No.: 09/049,118

[22] Filed: Mar. 27, 1998

[30] Foreign Application Priority Data

Mar. 27, 1997 [IT] Italy ..... RM97A0177

[51] Int. Cl.[7] ..... B05B 9/043

[52] U.S. Cl. ..... 239/333; 239/350; 239/354; 239/571; 239/574; 222/321.9; 222/547; 222/564

[58] Field of Search ..... 239/333, 337, 239/350, 353, 354, 533.13, 533.14, 570, 571, 574; 222/321.7, 321.9, 382, 547, 564

[56] References Cited

U.S. PATENT DOCUMENTS

| | | | |
|---|---|---|---|
| 3,414,169 | 12/1968 | Corsette | 222/321.9 |
| 3,463,093 | 8/1969 | Pfeiffer et al. | 22/321.9 X |
| 3,680,790 | 8/1972 | Boris | 239/353 |
| 3,769,325 | 10/1973 | Jouillat et al. | 239/337 |
| 3,949,939 | 4/1976 | Brown | 239/350 |

FOREIGN PATENT DOCUMENTS

| | | |
|---|---|---|
| 0370257 | 5/1990 | European Pat. Off. . |
| 0452260 | 10/1991 | European Pat. Off. . |
| 0686434 | 12/1995 | European Pat. Off. . |
| 1529773 | 10/1978 | United Kingdom . |
| 9427732 | 12/1994 | WIPO . |

*Primary Examiner*—Andres Kashnikow
*Assistant Examiner*—Steven J. Ganey
*Attorney, Agent, or Firm*—Browdy and Neimark

[57] ABSTRACT

The present invention relates to a micropump for the nebulization of fluids with enhanced metering valve. The micropump comprises a hollow body and a set of stem and piston such as to constitute a "metering chamber" in the body. The hollow stem, which exits the body, is joined with a dispensing push-button fitted with a nebulization element. Pressing the dispensing push-button allows the passage of the fluid to be nebulized from the "metering chamber" to an exit duct, comprising the longitudinal cavity of the stem, a "compression pre-chamber" in the dispensing button and passages from the chamber to the nebulization element. The metering valve is obtained by interposing, in said fluid exit duct, an elastically deformable shutter.

2 Claims, 3 Drawing Sheets

MICROPUMP FOR THE NEBULIZATION OF FLUIDS WITH ENHANCED METERING VALVE

BACKGROUND OF THE INVENTION

1. Technical Field of the Invention

The present invention relates to a micropump for the nebulization of fluids with enhanced metering valve. A micropump of this kind is suitable for mounting on a cap for glass or plastic bottles destined to contain perfumes or other substances which, according to their specific use, require nebulization.

2. Prior Art

Generally, this type of micropump comprises a pump body and a set of hollow stem and piston such as to constitute together with the body a "metering chamber". The exit duct for the fluid includes the longitudinal cavity of the hollow stem, a so called "compression pre-chamber" obtained in a dispensing push-button and at least a passage from this "compression pre-chamber" to a "vortex chamber" of a nebulization element fitted with related orifice. The stem and piston set is movable within the body thanks to the antagonistic action between the dispensing push-button and a helical spring, abutting in the "metering chamber" against the front end of the stem. The stem and the piston of the set are, themselves, mutually movable to uncover one or more through holes in the stem, at the moment the dispensing push-button is pressed to allow the fluid to be nebulized to pass from the "metering chamber" into the fluid exit duct.

In a system of this type the pressure inside the "metering chamber" necessary to obtain a correct nebulization is guaranteed by a valve, which could be called "minimum pressure" valve, obtained with the aforesaid piston and a "pre-loading" spring abutted between the piston and a flange provided on the stem inside the pump body. Such "minimum pressure" valve determines the threshold pressure which must exist in the "metering chamber" for the through holes of the stem to be uncovered, and the pressurized fluid to travel through the longitudinal cavity of the stem to reach the "compression pre-chamber", and accelerated and exited from the orifice of the nebulization element, creating the nebulization cone.

In the prior art system the correct nebulization requires the fluid to reach the "compression pre-chamber" with sufficient pressure to be accelerated adequately. This depends mainly on the head losses the fluid undergoes in its exit duct. The smaller the head losses, with the threshold pressure being equal, the more pressure the fluid maintains in correspondence with the "compression pre-chamber". Since the "minimum pressure" valve, comprised by the piston which covers and, vice versa, uncovers the holes by means of the "pre-loading" spring, is situated away from the "compression pre-chamber", the head losses, i.e. those along the hollow stem, are significant, and hence pressure in the "compression pre-chamber" can be insufficient.

Pump systems already exist which use micro-springs associated to micro-shutters positioned inside the cylindrical duct of the stem in the vicinity of the nebulization element, which acting on small sections, maximize, other conditions being equal, the dispensing pressure value. Such systems, however, are particularly complex and, given their small size, the production of their components and their assembly, especially in terms of dimensional precision and repeatability, are very onerous, and thus entail an increase of the final cost of the pumps and of the containers whereto they are applied.

SUMMARY OF THE INVENTION

The object of the present invention therefore is to eliminate the drawbacks mentioned above.

The invention, solves the problem of providing a micropump for the nebulization of fluids with enhanced metering valve, of the type mounted on a bottle cap and comprising a hollow body, which receives from below a suction tube, is fitted at the bottom with a check ball valve and it is closed at the top with a flange connecting to said cap, a stem and piston set such as to constitute a "metering chamber" in the part of said body delimited by said ball valve, the stem, hollow, exiting from said body through said connecting flange and being joined at the top with a manually compressed dispensing push-button provided with a nebulization element equipped with related orifice. The stem and piston set movable within said body thanks to the antagonistic action between said dispensing push-button and a helical spring, abutted in said "metering chamber" against the front end of said stem. The stem and the piston of said stem-and-piston set are themselves mutually movable to uncover holes, obtained through said stem, at the moment the dispensing push-button is pressed in order to allow the passage of the fluid to be nebulized from said "metering chamber" to a duct for the exit of the fluid itself. A longitudinal cavity of said hollow stem, a so-called "compression pre-chamber" obtained in said dispensing push-button and passages to a "vortex chamber" of said nebulization element, which from a general point of view, is characterized in that said stem and piston complex in said pump body realizes a metering valve by the interposition, in said fluid exit duct, of a shutter which is elastically deformable to a calibrated extent upon a pressure increase in the duct itself in order to allow the passage of the fluid to said nebulization element orifice.

According to the invention the aforesaid antagonistic function, performed by the spring in the conventional pump, is assumed by the elastically deformable shutter positioned in the fluid exit duct. The counter pressure, which is created in the duct due to the presence of the shutter, grows until it equals a set minimum or threshold pressure for the metering chamber, sufficient to create an adequate nebulization. This pressure is the one sufficient to deform the shutter elastically, allowing the pressurized fluid to pass beyond the temporarily deformed shutter until reaching the orifice of the nebulization element. The advantage is derived that the presence of a "pre-loading" spring is no longer necessary, the spring being replaced by a component, such as an elastomeric dowel, which is less costly and easier to dispose of and recycle.

An additional, and not secondary, functional advantage is that with the shutter according to the present invention the quantity of product normally in contact with air is reduced. This can have a certain importance in preventing the volatilization of perfumes or the like, but especially the spoiling of other substances perishable in air, which are dispensed by means of the type of micropurmp in question.

BRIEF DESCRIPTION OF THE DRAWINGS

Additional characteristics and advantages of the present invention shall be made clearer by the detailed description that follows, of a preferred embodiment shown purely by way of non-limiting indication in the accompanying drawings, in which.

DESCRIPTION OF THE PREFERRED EMBODIMENTS

Figure 1:
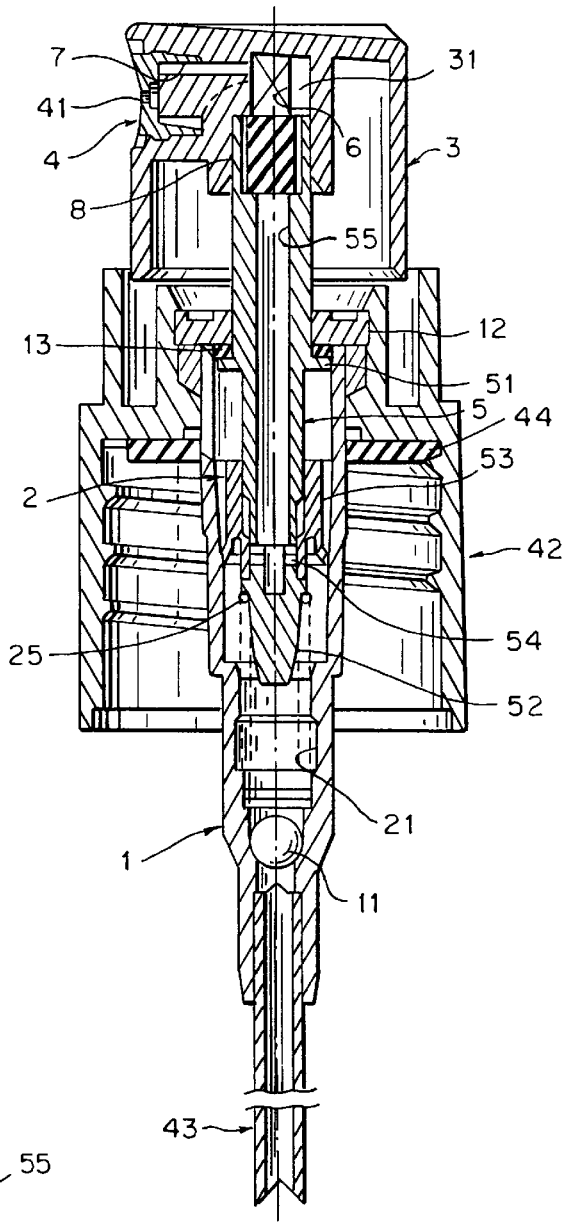
FIG. 1 shows a longitudinal section of a first embodiment of a micropump according to the present invention in resting condition.
Figure 2:
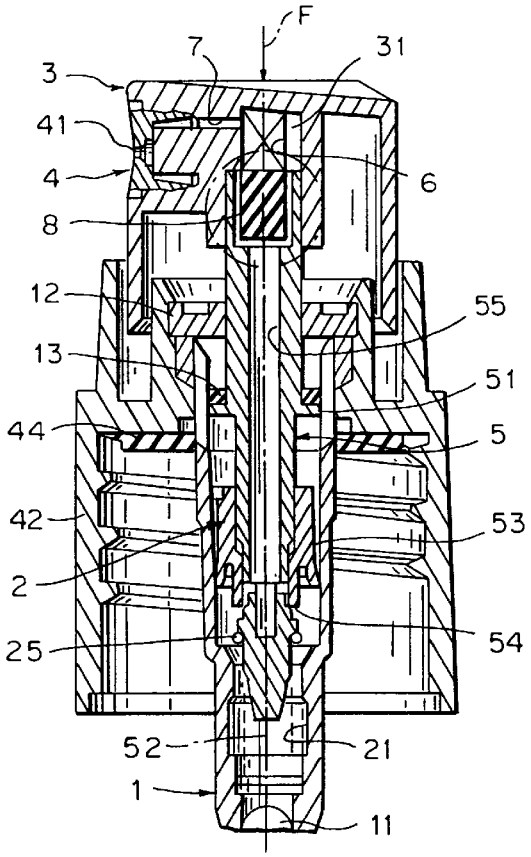
FIG. 2 shows a longitudinal section of the first embodiment of a micropump according to the present invention in dispensing condition.

In FIGS. 1 and 2, wherein a first embodiment of the invention is shown, the number 1 indicates a hollow pump body, 2 a stem and piston set, 3 a dispensing push-button, 4 a nebulization element, 42 a bottle cap and 43 a suction tube.

The micropump for the nebulization of fluids according to the invention is mounted on cap 42, destined to be screwed, with the interposition of a gasket seal 44, on the neck of a bottle not shown. The micropump includes the hollow body 1. Conventionally, the hollow body 1 is an extended container, open at both its ends. In its lower end opening is inserted the suction tube 43, destined to be immersed in the fluid to be nebulized. The hollow body 1 is fitted at its bottom with a ball check valve 11 and it is closed at the top with a flange 12 connecting to the bottle cap 42.

The stem and piston set 2 within the hollow body comprises a "metering chamber" 21 in the lower part of the hollow body 1, i.e. the one delimited by the ball valve 11. Conventionally, the stem and piston set 2 comprises a hollow stem 5, with inner cavity 55, which protrudes, at the rear, from the hollow body 1 through a flange 12 providing connection to the cap 42. The hollow stem 5 is joined at the rear to the dispensing push-button 3, conformed with diametrical baffles, like the one indicated with 31, in an inner crown such as to provide abutment for the hollow stem 5. The dispensing push-button 3 therefore presents a so-called "compression pre-chamber" 6 with passages 7 to an orifice 41 of the nebulization element or insert 4, wherein a "vortex chamber" is provided.

The hollow stem 5 presents in appropriate position a flange projection 51 abutting against the connecting flange 12, whereon a gasket seal 13 is provided. Conventionally, the hollow stem 5 presents, in its front portion, a distinct head 52. On the head 52 abuts an end of a helical spring 25, whose other end abuts against the lower portion of the hollow body 1. The hollow stem 5 and its head 52 have such a structure as to allow the insertion onto the hollow stem 5 of a piston 53. The piston 53 is externally shaped with circumferential lips for sealing the inner surface of the hollow body 1, whilst internally it presents two portions of different diameter for its limited sliding on corresponding portions of the hollow stem 5. Conventionally, in the hollow stem portion 5 next to the head 52 is provided at least one through hole 54, which places in communication the "metering chamber" 21 with the interior of the hollow stem 5.

In the first embodiment of the micropump according to the invention shown in FIGS. from 1 to 3, the hollow stem 5 presents in its rear end a seat 56 for an elastically deformable shutter, constructed in the shape of a cylindrical dowel 8. In this way a metering valve is obtained. The dowel 8, which may also have any other appropriate shape, is interposed in the exit duct of the fluids to be nebulized coming from the suction tube 43. From the "metering chamber" 21 through one or more holes 54, the exit duct develops in the longitudinal cavity 55 of the hollow stem, in the seat 56 for the shutter, in the "compression pre-chamber" 6 and in the passages 7 of the dispensing push-button 3 to the exit orifice 41 of the nebulization element 4.

Figure 3:
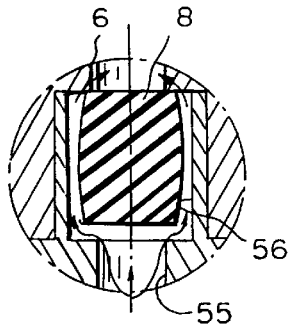
FIG. 3 shows, in enlarged scale, a detail circled in FIG. 2.

The operation of the first embodiment of the micropump according to the invention is described hereafter. When the user presses the dispensing push-button passing from the resting condition shown in FIG. 1 to the dispensing condition shown in FIG. 2, the stem and piston set 2 under the action of the force F moves in its entirety downwards, but thanks to the antagonist action imparted by the pressure of the fluid contained in the "metering chamber" 21, the stem 5 and the piston 53 undergo a relative motion which uncovers the through holes 54 of the stem 5. The pressurized fluid, from the "metering chamber" 21 passes into the longitudinal cavity 55 of the stem 5 and into the seat 56. The dowel 8 is transformed from its non-deformed condition of FIG. 1, when the pressure within the longitudinal cavity 55 is lower than the minimum or threshold pressure for nebulization, to the elastically deformed condition of FIGS. 2 and 3. In this second condition, the fluids pass beyond the seat 56 of the dowel 8, lapping it (as shown schematically by the flow lines in FIG. 3), reach the "compression pre-chamber" 6, and hence the passages 7 through to the exit orifice 41. Upon the exit of the fluids, the pressure in the longitudinal chamber 55 and in the "metering chamber" 21 drops below the minimum or threshold value regulated by the rigidity of the dowel 8, which closes the fluid exit duct. The user releases the dispensing push-button 3 which, moving back upwards, increases the vacuum in the "metering chamber" 21. The ball valve 11 opens the passage from the suction tube 43 and new fluid passes from the bottle to the "metering chamber" 21 of the micropump for subsequent nebulization upon repeated pressing of the dispensing push-button 3.

Figure 4:
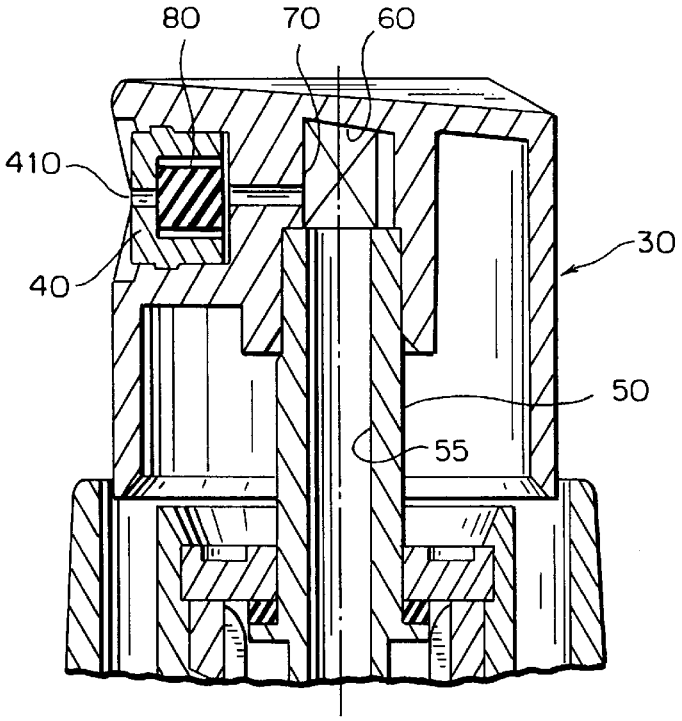
FIG. 4 shows a partial longitudinal section of a second embodiment of a micropump according to the present invention in resting condition.
Figure 5:
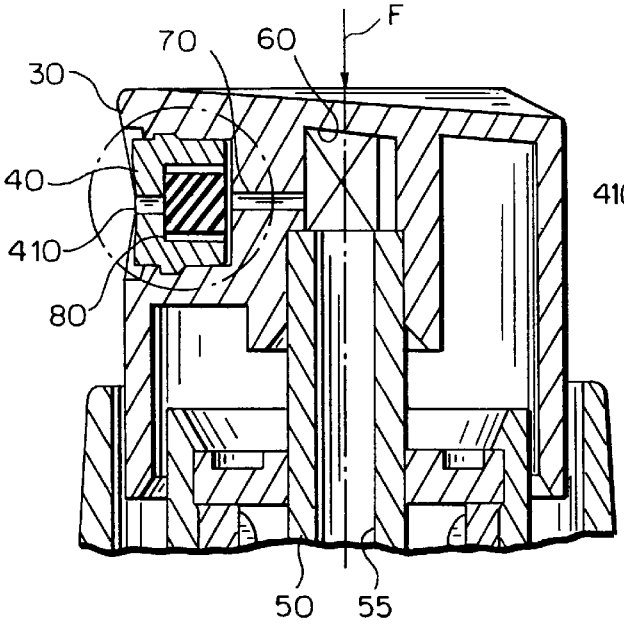
FIG. 5 shows in partial longitudinal section the second embodiment of a micropump according to the present invention in dispensing condition.
Figure 6:
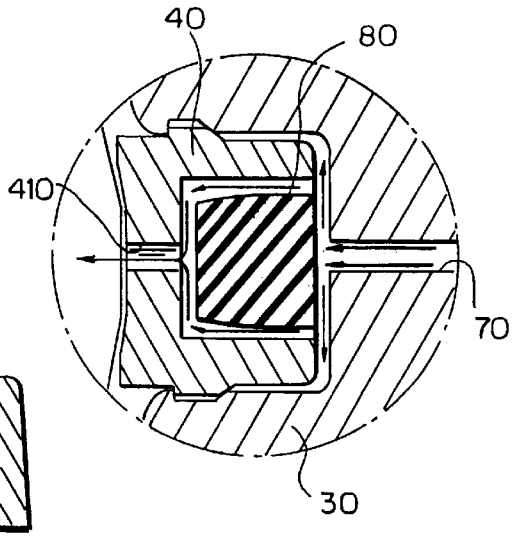
FIG. 6 shows in enlarged scale a detail circled in FIG. 5.

In a second embodiment of the micropump according to the invention shown in FIGS. 4 through 6, the shutter is a cylindrical dowel 80 made of elastomeric material positioned within a nebulization element 40 coaxially to a passage 70 between a "compression pre-chamber" 60 and a nebulization element orifice 410 in a dispensing push-button structure 30, modified with respect to that of the first embodiment.

Figure 7:
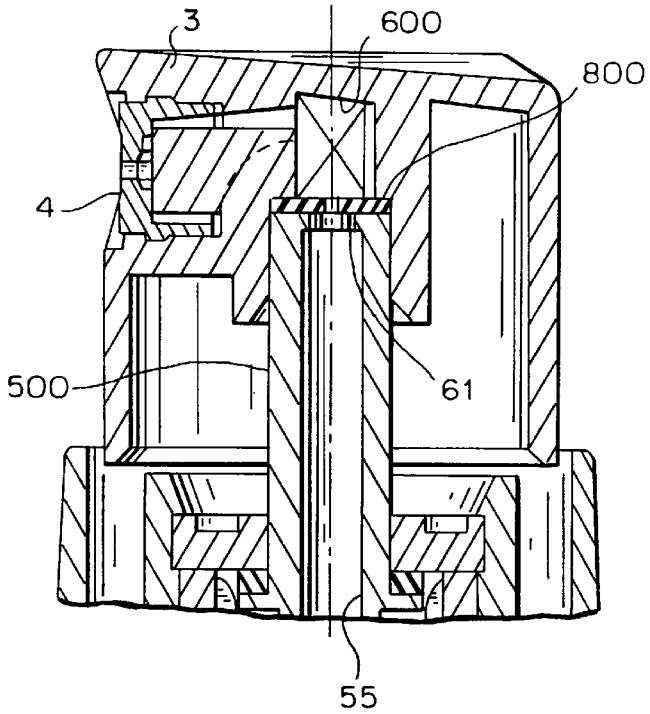
FIG. 7 shows a partial longitudinal section of a third embodiment of a micropump according to the present invention in resting condition.
Figure 8:
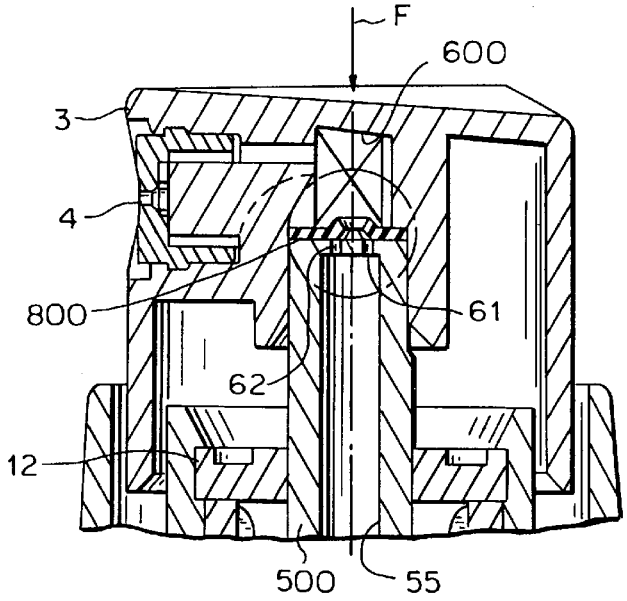
FIG. 8 shows a partial longitudinal section of the third embodiment of a micropump according to the present invention in dispensing condition.
Figure 9:
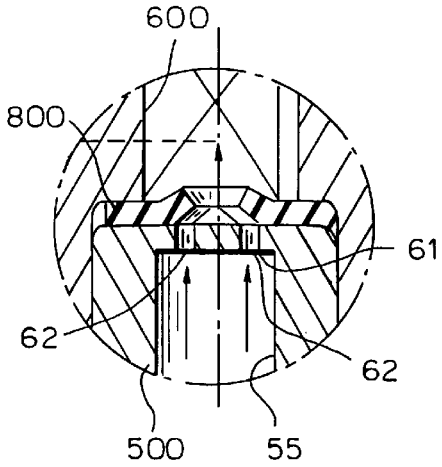
FIG. 9 shows in enlarged scale a detail circled in FIG. 8.

In operation, when the user presses the dispensing push-button passing from the resting condition shown in FIG. 4 to the dispensing condition in FIG. 5, the displacement of the stem and piston set 2 under the action of the force F downward causes pressure inside the entire exit duct, described above with reference to the first embodiment, to increase. The pressurized fluid, from the "metering chamber" (not shown) passes to the longitudinal cavity 55 of the stem 50. The dowel 80 passes from its non-deformed condition shown in FIG. 4, when pressure within the exit duct is lower than the minimum or threshold pressure for nebulization, to the elastically deformed condition in FIGS. 5 and 6. In this second condition, the fluids move beyond the inner cavity of the nebulization element 40, seat of the dowel 80. The fluid, lapping the dowel 80, reaches the exit orifice 410 for nebulization. In a third embodiment of the micropump (FIGS. 7 through 9), the longitudinal cavity 55 of a hollow stem 500 is closed, in proximity with a "compression pre-chamber" 600, with a baffle 61, provided with a plurality of circumferential holes 62. The baffle 61 is obtained in a single piece with the hollow stem 500. The shutter is a disk or platelet 800 with a hole in its center, positioned facing the baffle 61 in proximity to the "compression pre-chamber" 600.

In operation, when the user presses the dispensing push-button 3, the pressurized fluid deforms the baffle 61 upward and flows past the circumferential holes 62. As in the embodiments described above, the shutter must present a rigidity suitably adjusted to allow for easy dispensing.

What is claimed:

1. Micropump for the nebulization of fluids with enhanced metering valve mounted on a bottle cap, said micropump comprising:

a hollow body having a suction tube and a ball check valve at a bottom end thereof, said hollow body being closed at a top end with a flange connecting to said bottle cap;

a hollow stem and piston set constituting a "metering chamber" in the part of said hollow body delimited by said ball valve, the hollow stem protruding outside said body through said connecting flange and being joined at a top of said hollow stem to a dispensing push-button to be compressed manually, said dispensing push-button having a nebulization element fitted with a related orifice;

said hollow stem and piston set being movable within said hollow body by an antagonistic action between said dispensing push-button and a helical spring abutted in said "metering chamber" against a front end of said hollow stem;

the hollow stem and the piston of said hollow stem and piston set being mutually movable to uncover through holes located in said hollow stem when the dispensing push-button is pressed in order to allow the passage of the fluid to be nebulized from said "metering chamber" to a duct for the exit of the fluid, said "metering chamber" comprising a longitudinal cavity in said hollow stem, a "compression pre-chamber" in said dispensing push-button having passages to a "vortex chamber" in said nebulization element, wherein said hollow stem and piston set in said hollow pump body has a metering valve through the interposition in said duct for the exit of the fluid of a shutter elastically deformable in a pre-set measure as a result of an increase in pressure in the duct in order to allow the metered passage of fluid through to said orifice of the nebulization element.

2. Micropump according to claim 1, wherein said shutter is a cylindrical dowel made of elastomeric material positioned in a seat obtained in the end of said stem in proximity with said "compression pre-chamber".

* * * * *